US006167575B1

(12) United States Patent
Smith

(10) Patent No.: US 6,167,575 B1
(45) Date of Patent: Jan. 2, 2001

(54) BATHROOM VENTILATOR INLET

(76) Inventor: James Norman Smith, 1070 Roch Street, Winnipeg, Manitoba (CA), K2K 2R3

( * ) Notice: Under 35 U.S.C. 154(b), the term of this patent shall be extended for 0 days.

(21) Appl. No.: 09/397,878

(22) Filed: Sep. 17, 1999

(51) Int. Cl.[7] ..... E03D 9/04
(52) U.S. Cl. ..... 4/209; 4/213; 454/341
(58) Field of Search ..... 4/209 R, 210, 4/211, 213, 214, 215, 216, 217, 218, 219; 454/341, 345, 347, 353

(56) References Cited

U.S. PATENT DOCUMENTS 2,326,957 * 8/1943 Maguire .
3,202,083 * 8/1965 Eichhorn .
3,415,178 * 12/1968 Ball et al. .
3,479,947 * 11/1969 Myers .
3,587,437 * 6/1971 McEwen ..... 454/341
3,902,203 * 9/1975 Poister et al. ..... 4/213
4,556,999 * 12/1985 Lindley ..... 4/217
4,770,679 * 9/1988 Slaughter .
5,067,394 * 11/1991 Cavallero .
5,720,661 * 2/1998 Yoshizawa et al. ..... 454/341
5,845,870 * 12/1998 Angle ..... 242/58.5

* cited by examiner

*Primary Examiner*—Steven O. Douglas
*Assistant Examiner*—Khoa D. Huynh
(74) *Attorney, Agent, or Firm*—David J. French

(57) ABSTRACT

A bathroom ventilation air inlet is mounted in conjunction with a toilet paper dispenser. Activation of a suction source connected by conduit to the inlet draws air from the bathroom, removing odour and moisture. The system also operates using a central vacuum system as a suction source. In such case the air inlet has a valve to seal and open the air inlet.

7 Claims, 7 Drawing Sheets

BATHROOM VENTILATOR INLET

FIELD OF THE INVENTION

This invention relates to room ventilation systems. In particular, it relates to a wall or ceiling-mounted outlet to exhaust air from a room in a building, such as a bathroom or toilet room through a central vacuum system.

BACKGROUND TO THE INVENTION

Room ventilation systems are known. Bathrooms in particular have switch-activated fans and ceiling-mounted outlets that remove air from bathrooms. The ventilation of bathrooms is particularly appropriate to remove odours and moisture.

This application concerns a new arrangement for ventilating a room, such as a bathroom. It relies in one aspect on the fact that a penetration must be made in the wall of a bathroom to install a wall-mounted toilet paper dispenser. This invention also relies, in another aspect, upon the use of a central vacuum system as an exhaust means.

A central vacuum system involves the installation of suction conduits throughout a house. These conduits terminate in multiple outlets that are individually sealed until accessed to take advantage of the suction created by the system to effect household cleaning. The present invention addresses these background structures to propose a new combination that provides new and useful benefits for bathroom ventilation.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention an air outlet to exhaust air from a room through an exhaust system is provided. Preferably the outlet, when installed in a bathroom, is mounted in the housing of a toilet paper holder or dispenser so that both elements can be installed in the same wall penetration in the wall of a bathroom. According to another aspect of the invention the exhaust outlet is a suction inlet which is mounted at any location within a room, such as a bathroom, and is coupled through a conduit to a central vacuum system as a suction source and air evacuation means. In either case, switch means is provided to activate exhaustion of air from the room preferably through a grill mounted before a plenum to screen and diffuse the air flow being sucked into the conduit.

The suction source is electrically activated by a switch that preferably is accessible to a person resting on the seat of a toilet. Conveniently, the switch may be carried by the same housing which carries the toilet paper and exhaust outlet of the invention. A conduit, preferably concealed within walls, connects the exhaust outlet/suction inlets, whether of a simple or toilet paper holder type, to the suction source. Activation of the switch draws air from the room being ventilated to the suction source, whereafter the air is ejected by the suction source either to the outside environment or into a remote room, such as a household basement.

While the suction source may simply be a remotely mounted fan, a preferred suction source is a central vacuum system vacuum suction generator. In the case of a central vacuum system, multiple wall-mounted room suction inlets are generally provided, each with their own closure. Failure to effect closure of unused suction inlets will result in loss of suction intensity at a used suction inlet.

To adapt the room air exhaust outlet described above to a central vacuum system, a conduit closure means or valve is provided. Such a valve may be carried by the common housing for the suction inlet, or where combined, for a toilet paper holder. Until this valve is opened, the suction inlet of the invention is sealed. Conveniently, activation of a common control lever can serve to both mechanically open the conduit valve and electrically activate the suction source or the lever may operate the conduit valve through a solenoid.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
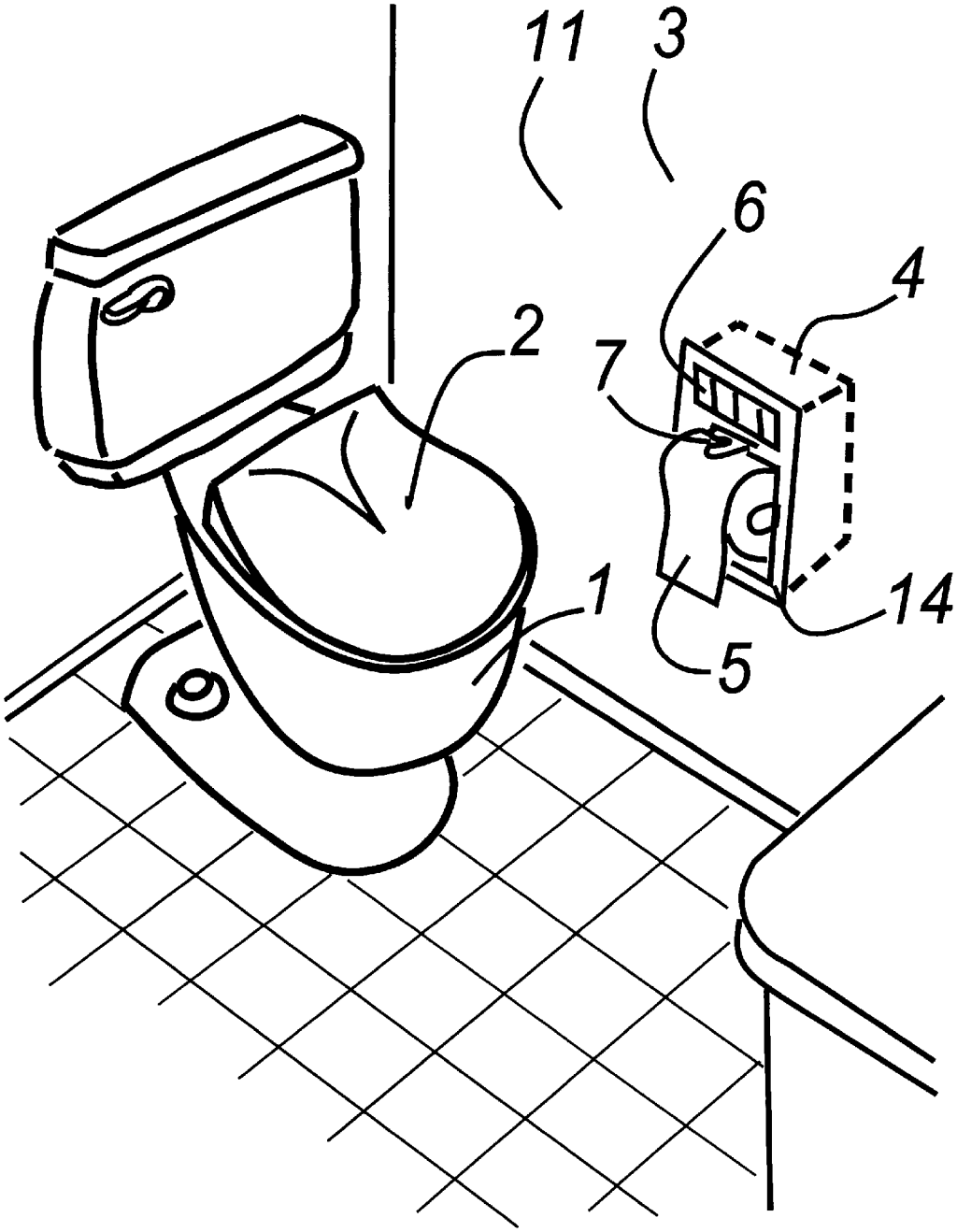
FIG. 1 is a perspective view of a bathroom interior with a toilet and adjacent wall-mounted toilet paper dispenser with exhaust outlet/suction inlet, according to the invention.

In FIG. 1 a toilet 1 with a seat cover 2 is installed adjacent to a wall 3 in a bathroom 11. In the wall 3 a toilet paper dispenser housing 4, carrying toilet paper 5, is installed. Mounted in the dispenser housing 4 is an air evacuation opening 6 to remove air from the bathroom 11. A lever 7 activates an electrical switch 9 that turns-on a suction source 10 mounted remotely from the bathroom 11. A conduit 12 for evacuating air extends between the suction source 10 and the air evacution opening 6. Activation of the lever 7 also opens an conduit valve 13 within the housing 4 that otherwise seals the conduit 12.

Figure 2:
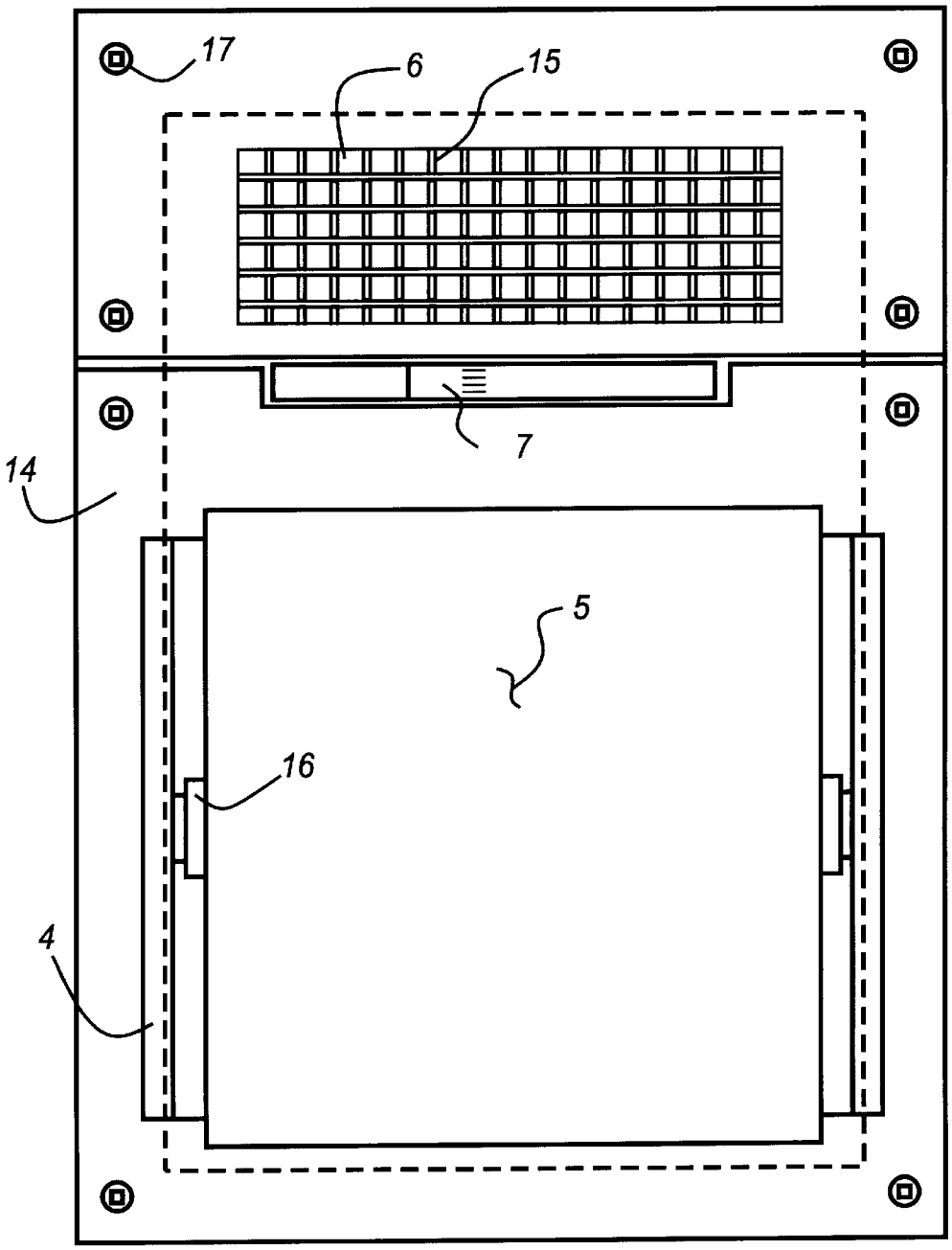
FIG. 2 is a face view of the front plate of the dispenser of FIG. 1.

FIG. 2 shows the face plate 14 carried by the frame 4 as mounted in the wall. Screws 17 attach this plate 14 to the frame 4. A grill 15 overlies the exhaust opening 6. A spindle 16 passing through the roll of toilet paper 5 is fitted to the housing 4.

Figure 3:
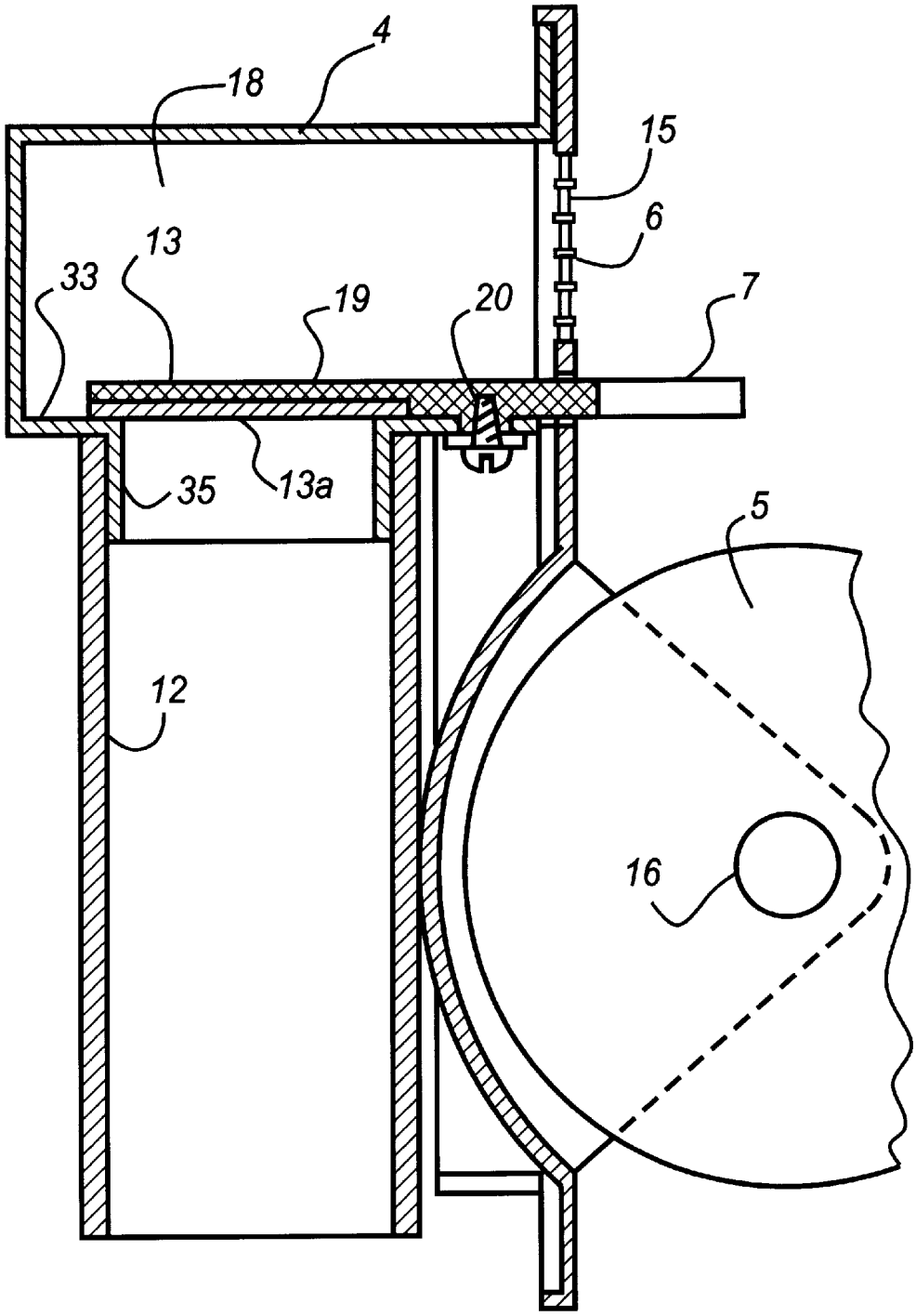
FIG. 3 is a cross-sectional side view of the dispenser of FIG. 1.

FIG. 3 shows the presence of a plenum 18 behind the grill 15 separated from the conduit 12 by the valve 13. The valve 13 is carried by a lever arm 19 that swings about hinge screw 20 when the lever 7 is rotated sideways. Hinge screw 20 is mounted on housing 4.

Figure 4A:
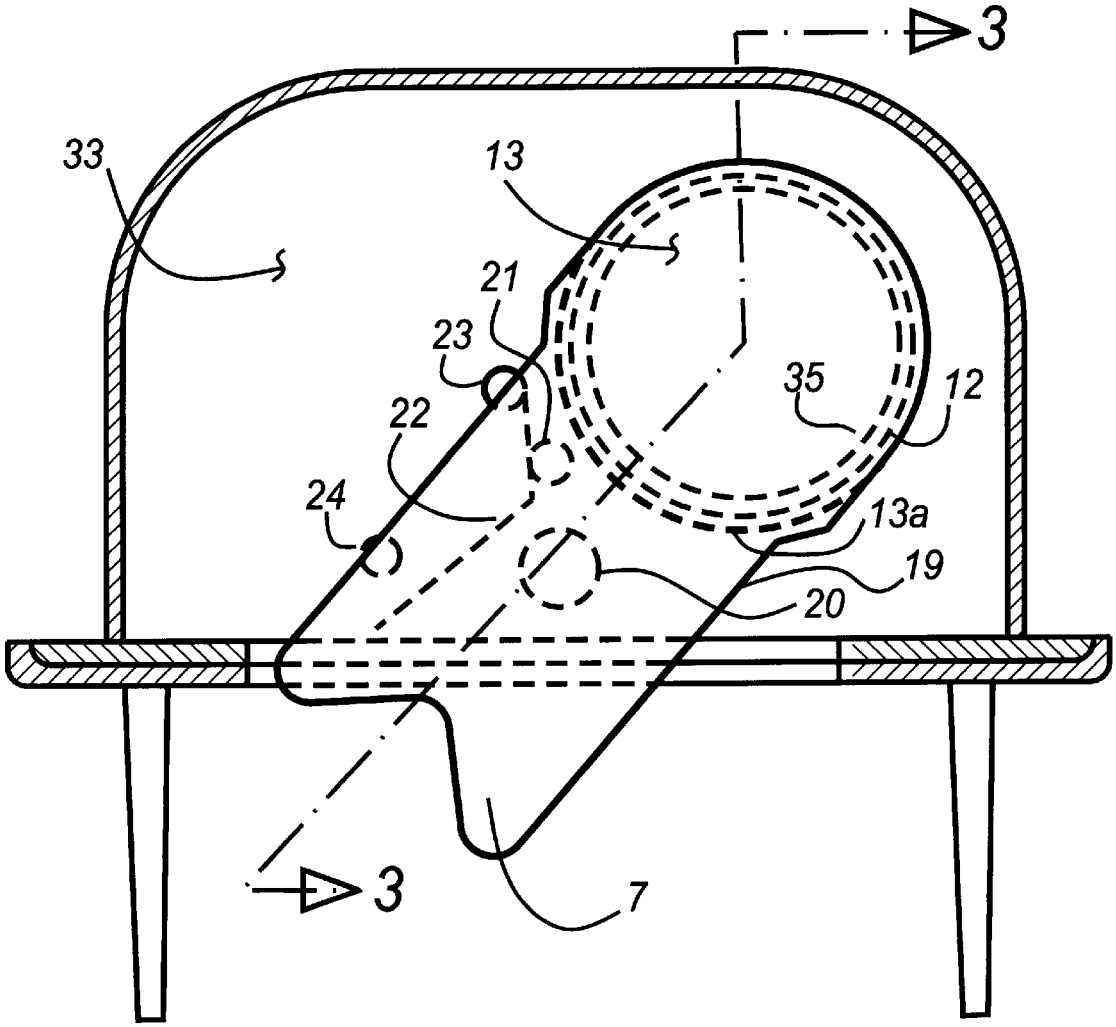
FIGS. 4A and 4B are cross-sectional plan views of the dispenser of FIG. 1, taken just above the conduit valve lever, respectively showing the conduit sealed and open.
Figure 4B:
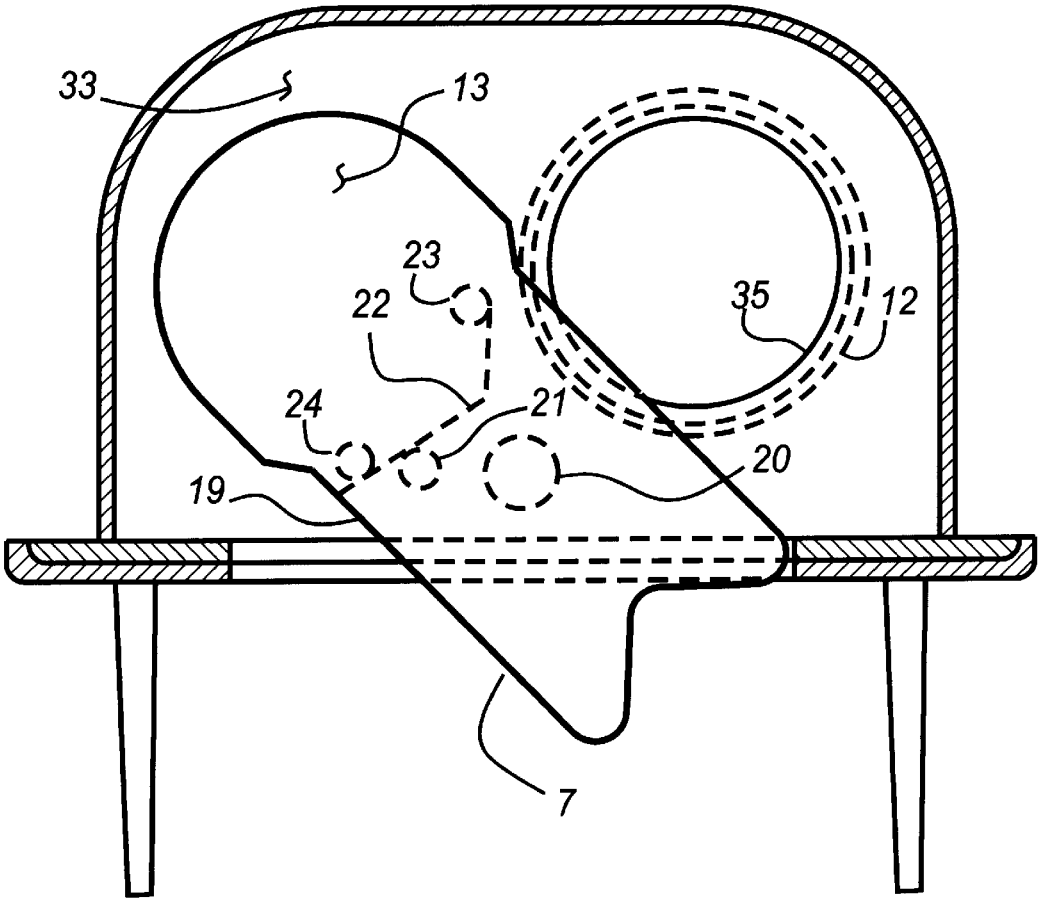

In the plan views of FIGS. 4A, 4B the action of swinging the lever 7 is shown as opening and sealing the conduit 12 by removing and replacing the valve 13 with its gasket 13*a* over the end of the conduit 12. The activated, conduit "open" position is shown in FIG. 4B. The closed, "off" position is shown in FIG. 4A. The action of swinging the lever arm 19 causes a pin 21 carried on the underside of lever arm 19 to press a spring wire 22 mounted on a seat 23 carried by plenum floor 33 which separates the air flow from the toilet paper so as to bear against electrical contact 24. This closes a low voltage circuit which activates relay 9 and turns on the suction source 10.

The spring 22 may be bent to provide a detent to effect a "toggle" action that stabilizes the lever arm 19 in either the closed or open position. The fit of the lever arm 19 with the hinge screw 20 may have sufficient play or looseness to allow the surface of valve gasket 13*a* to be carried over the upper end of the opening 35 that provides an entry into conduit 12.

Figure 5:
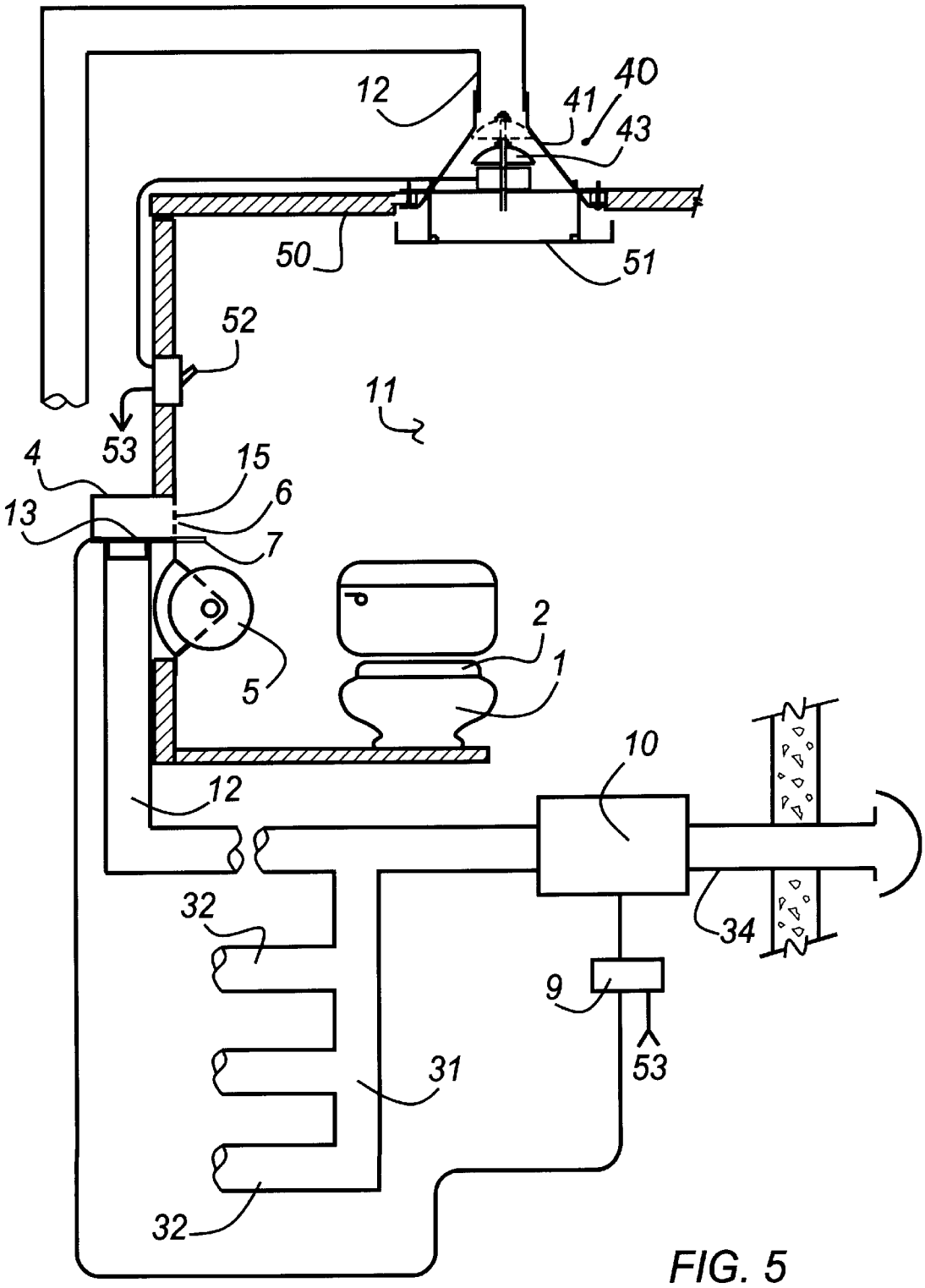
FIG. 5 is a schematic view of the conduit system terminating at a suction source that evacuates air from the bathroom, either through a toilet paper holder outlet or through a ceiling mounted outlet.

In FIG. 5, the suction source 10 is the suction generator of a central vacuum system. The activation of suction source 10 causes air drawn from the bathroom 11 to be exhausted outside by vent pipe 34. Other conduits 32 connected through a manifold 31 to the suction source 10 remain sealed while conduit 12 is open. Conversely, with valve 13 shut, the other conduits 32 will be functional to provide suction.

Figure 6:
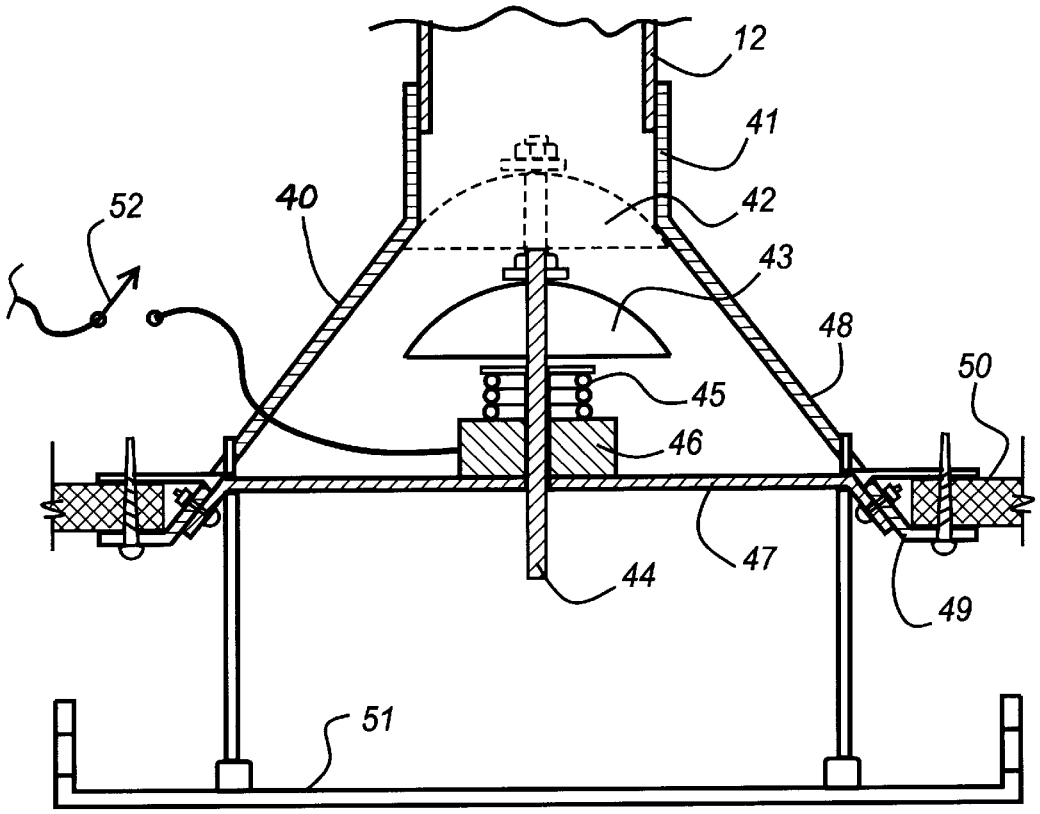
FIG. 6 is a detailed cross-sectional side view of the ceiling mounted outlet of FIG. 5.

In FIG. 6, the alternate ceiling mounted outlet 40 present in FIG. 5 is shown in a detailed cross-section. The conduit 12 is coupled to a complementary coupling section 41 which has a downwardly-directed open end 42 into which a sealing member 43, shown shaped as a hemisphere, may enter to serve as a valve. The sealing member 43 is carried on a plunger 44 that passes through a spring 45 and solenoid coil 46. The coil 46 rests on a transverse support 47 that connects to the frame 48 supporting the coupling section 41. Flanges 49 allow the frame 48 to be connected to the ceiling 50. A cover plate 51, shown at a partially disengaged location, may be provided to conceal the mechanism aesthetically.

The spring 45 urges the plunger 44 to carry the sealing member 43 upwards to cover the open end 42 and seal the conduit 12 against vacuum loss. Activation of the solenoid coil 46 withdraws the plunger 44 and sealing member 43, opening the end 42 of the coupling section 41. A switch 52, conveniently mounted on the room wall, provides current both to the ceiling solenoid 46 and, through wire 53, to the relay 9 to activate the suction source 10.

Thus, it has been shown how a wall or ceiling-mounted exhaust outlet may be provided in a room, such as a bathroom to remove odorous air therefrom in response to ready activation by a user of a switch that both opens an exhaust conduit and activates a suction source. In the case of a bathroom, the exhaust outlet may be conveniently located in the same housing as a toilet paper dispenser. By using the remotely located fan of a central vacuum system as the suction source 10, high volumes of air may be extracted from such a room without the intrusion of noise from a locally installed exhaust fan. By providing a sealed termination at the conduit end of a central vacuum system, the central vacuum system is able to continue to operate in the normal manner through the manifold 31 when the exhaust outlet is closed. Operation of the central vacuum system is only disabled for a short time during activation of the exhaust outlet of the invention.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed are as follows:

1. A room air exhaust outlet for connection to a suction source to provide part of a room ventilation system comprising:

1) a toilet paper dispenser further comprising a housing;

2) an exhaust outlet aperture carried by the housing;

3) a conduit coupling connected to the exhaust outlet aperture whereby a conduit may be coupled between the exhaust outlet aperture and a suction source;

4) a grill carried by said housing and positioned in the path that air would flow on approaching said exhaust outlet aperture;

5) an electrical switch for connection to and activation of a suction source; and 6) valve means for opening and interrupting the flow of air into the conduit.

2. A system as in claim 1 comprising a lever mounted on said housing wherein the electrical switch and valve means are both actuated by displacement of said lever.

3. A system in claim 2 comprising a plenum with a plenum wall located between the grill and the suction inlet wherein the plenum wall separates the air flow path from the toilet paper dispenser.

4. A room air exhaust system for a room having walls and a ceiling comprising:

1) a suction inlet carried in a housing which is mounted in a wall of a room, said inlet having a valve means for opening and interrupting the flow of air through said inlet;

2) a conduit connected to the suction inlet to receive and carry-off air entering therethrough;

3) a central vacuum cleaner suction generator to serve as a suction source connected through said conduit to the suction inlet;

4) an electrical switch connected for activation of the suction source;

5) a control lever connected to the valve means to said valve means; and 6) a toilet Paper dispenser carried by said housing.

5. A system as in claim 4 wherein the control lever is positioned to both open the valve means and activate at the same time the electrical switch for turning on the suction source.

6. A system as in claim 5 comprising a grill carried by said housing and positioned in the path of the flow of air approaching said suction inlet.

7. A system in claim 6 comprising a plenum with a plenum wall located between the grill and the suction inlet wherein the plenum wall separates the air flow path from the toilet paper holder.

* * * * *